US012349743B2

(12) United States Patent
Kimel et al.

(10) Patent No.: US 12,349,743 B2
(45) **Date of Patent: *Jul. 8, 2025**

(54) LOWER TORSO GARMENT WITH SUPPORT ELEMENT

(71) Applicant: HBI BRANDED APPAREL ENTERPRISES, LLC, Winston-Salem, NC (US)

(72) Inventors: Sherry E. Kimel, King, NC (US); Tasha R. Perry, Winston-Salem, NC (US); Rachel I. Erickson, Winston-Salem, NC (US); Melissa A. Coleman, Kernersville, NC (US)

(73) Assignee: HBI BRANDED APPAREL ENTERPRISES, LLC, Winston-Salem, NC (US)

( * ) Notice: Subject to any disclaimer, the term of this patent is extended or adjusted under 35 U.S.C. 154(b) by 16 days.

This patent is subject to a terminal disclaimer.

(21) Appl. No.: 17/818,698

(22) Filed: Aug. 9, 2022

(65) Prior Publication Data

US 2022/0378114 A1 Dec. 1, 2022

Related U.S. Application Data

(63) Continuation of application No. 17/238,665, filed on Apr. 23, 2021, now abandoned, which is a (Continued)

(51) Int. Cl.

| | |
|---|---|
| ***A41B 9/02*** | (2006.01) |
| *A41B 9/00* | (2006.01) |
| *A41B 9/12* | (2006.01) |

(52) U.S. Cl.

CPC ..... *A41B 9/023* (2013.01); *A41B 9/026* (2013.01); *A41B 9/001* (2013.01); *A41B 9/004* (2013.01);

(Continued)

(58) Field of Classification Search

CPC ..... A41B 9/023; A41B 9/026; A41B 9/001; A41B 9/004; A41B 9/005; A41B 9/02;

(Continued)

(56) References Cited

U.S. PATENT DOCUMENTS 2,570,498 A * 10/1951 Senderowitz ..... A41B 9/02 2/403

3,654,634 A * 4/1972 Torres ..... A41B 9/02 2/403

(Continued)

*Primary Examiner* — Khaled Annis
*Assistant Examiner* — Dakota Marin
(74) *Attorney, Agent, or Firm* — Husch Blackwell LLP

(57) ABSTRACT

A boxer brief includes a waistband, a body portion, a left leg portion, a right leg portion, a front pouch disposed about a front region of the body portion provided in the form of a mesh fabric, a gusset, and a support sling. The support sling includes a left fabric panel extending along a left side periphery of the front pouch and connected to the bottom horizontal seam and a right fabric panel extending along a right side periphery of the front pouch and connected to the bottom horizontal seam. A portion of the left fabric panel overlaps a portion of the right fabric panel at an overlap area, the overlap area positioned adjacent to the bottom horizontal seam at the bottom of the front pouch.

11 Claims, 2 Drawing Sheets

Related U.S. Application Data continuation of application No. 16/090,539, filed as application No. PCT/US2017/027496 on Apr. 13, 2017, now Pat. No. 10,986,877.

(60) Provisional application No. 62/322,779, filed on Apr. 14, 2016.

(52) U.S. Cl.
CPC ..... *A41B 9/005* (2013.01); *A41B 9/02* (2013.01); *A41B 9/12* (2013.01); *A41B 2300/22* (2013.01); *A41B 2300/35* (2013.01); *A41B 2400/38* (2013.01); *A41B 2500/10* (2013.01)

(58) Field of Classification Search
CPC ... A41B 9/12; A41B 2300/22; A41B 2300/35; A41B 2400/38; A41B 2500/10
USPC ..... 2/404, 403, 227
See application file for complete search history.

(56) References Cited

U.S. PATENT DOCUMENTS 4,345,337 A * 8/1982 Chung ..... A41B 9/023 2/405
4,377,008 A * 3/1983 Jung ..... A41B 9/023 2/403
5,070,869 A * 12/1991 Zhang ..... A41B 9/02 2/403
5,647,065 A * 7/1997 Richerson ..... A41B 9/023 2/403
5,870,779 A * 2/1999 Heron ..... A41B 9/023 2/403
6,622,312 B2 * 9/2003 Rabinowicz ..... B29C 66/431 2/274
6,662,378 B2 * 12/2003 Vartanyan ..... A41B 9/023 2/403
6,807,685 B1 * 10/2004 Hasegawa ..... A61F 13/505 2/400
7,434,273 B2 * 10/2008 Chung ..... A41B 9/023 2/403
7,958,571 B2 * 6/2011 Kitsch ..... A41B 9/023 2/403
8,230,526 B2 * 7/2012 Holland ..... A41D 7/005 2/403
8,555,422 B2 * 10/2013 Steele ..... A41B 9/023 2/403
9,375,035 B1 * 6/2016 Ingels ..... A41B 9/02
9,907,342 B2 * 3/2018 Fisher ..... A41D 27/20
10,058,463 B2 * 8/2018 Johnson ..... A41B 9/02
10,085,491 B2 * 10/2018 Howard ..... A41B 9/026
10,085,492 B2 * 10/2018 Polidan ..... A41B 9/001
2004/0025218 A1 * 2/2004 Huang ..... A41B 9/023 2/73
2005/0066408 A1 * 3/2005 Varela ..... A41D 27/12 2/69
2005/0235399 A1 * 10/2005 Kang ..... A41B 9/023 2/403
2006/0000008 A1 * 1/2006 Chong ..... A41B 9/023 2/403
2007/0245463 A1 * 10/2007 Kang ..... A41B 9/023 2/403
2007/0283484 A1 * 12/2007 Wright ..... A41B 9/02 2/403
2008/0072363 A1 * 3/2008 Williams ..... A41B 9/02 2/403
2014/0047620 A1 * 2/2014 Ingalls ..... A41B 9/02 2/403
2014/0304899 A1 * 10/2014 Almonte ..... A41F 17/00 2/403
2015/0223524 A1 * 8/2015 Brady ..... A41D 1/089 450/156
2017/0280783 A1 * 10/2017 Nouh ..... A41B 9/005
2018/0242650 A1 * 8/2018 Chou ..... A41B 9/023

* cited by examiner

LOWER TORSO GARMENT WITH SUPPORT ELEMENT

CROSS-REFERENCE TO RELATED APPLICATIONS

This application is a Continuation of and claims the benefit of U.S. patent application Ser. No. 17/238,665, filed Apr. 23, 2021, which is a Continuation of U.S. National Phase application Ser. No. 16/090,539, filed Oct. 1, 2018, which claims the benefit of priority to International Application Serial No. PCT/US2017/027496, filed Apr. 13, 2017, which claims priority to U.S. Provisional Application Ser. No. 62/322,779, filed Apr. 14, 2016, the contents of which are hereby incorporated by reference.

BRIEF SUMMARY OF THE INVENTION

This disclosure relates to lower torso garments having support elements, such as men's underwear.

SUMMARY

A boxer brief is provided. In one embodiment, the boxer brief comprises a waistband at an upper end of the boxer brief, a body portion, a left leg portion comprising a first leg opening at a lower longitudinal end of the left leg portion, a right leg portion comprising a second leg opening at a lower longitudinal end of the right leg portion, and a front pouch disposed about a front region of the body portion and provided in the form of a mesh fabric, the front pouch further defining a pass-through fly opening. A gusset is positioned at a bottom of the body portion between the left leg and right leg portions of the body portion, the gusset connected to the front pouch with a bottom horizontal seam at a bottom of the front pouch, and the bottom horizontal seam being entirely above the first leg opening and the second leg opening. A support sling is connected to the front pouch, the support sling comprising a left fabric panel comprising a left lateral seam and an exterior left lateral seam on the opposing side of the left fabric panel, the exterior left lateral seam extending along a left side periphery of the front pouch and connected to the bottom horizontal seam, and a right fabric panel comprising a right lateral seam and an exterior right lateral seam on the opposing side of the right fabric panel, the exterior right lateral seam extending along a right side periphery of the front pouch and connected to the bottom horizontal seam. A first portion of the left fabric panel overlaps a first portion of the right fabric panel at an overlap area, the overlap area positioned adjacent to the bottom horizontal seam at the bottom of the front pouch.

In other embodiments, the boxer brief comprises a body portion, a left leg portion comprising a first leg opening at a lower longitudinal end of the left leg portion, a right leg portion comprising a second leg opening at a lower longitudinal end of the right leg portion, a front pouch disposed about a front region of the body portion, a gusset positioned at a bottom of the body portion between the two leg portions of the body portion, the gusset connected to the front pouch with a bottom horizontal seam at a bottom of the front pouch, and a mesh support sling connected to the front pouch. The mesh support sling comprises a left fabric panel comprising, a first lateral outside edge extending along a left side periphery of the front pouch and comprising a left lateral seam adjacent to the first lateral outside edge and connected to the bottom horizontal seam, and a right fabric panel comprising a second lateral outside edge extending along a right side periphery of the front pouch and comprising a right lateral seam adjacent to the second lateral outside edge and connected to the bottom horizontal seam. A first portion of the left fabric panel overlaps a first portion of the right fabric panel at an overlap area, the overlap area positioned adjacent to the bottom horizontal seam at the bottom of the front pouch, and the bottom horizontal seam is entirely above the first leg opening and the second leg opening.

In other embodiments, the boxer brief garment comprises a body portion, a left leg portion comprising a first leg opening at a lower longitudinal end of the left leg portion, a right leg portion comprising a second leg opening at a lower longitudinal end of the right leg portion, a front pouch disposed about a front region of the body portion, and a bottom horizontal seam positioned adjacent to a bottom of the front pouch. A support sling is connected to the front pouch, the support sling comprising left fabric panel connected to the bottom horizontal seam and to a right side periphery of the front pouch, and a right fabric panel connected to the bottom horizontal seam and to a left side periphery of the front pouch. A first portion of the left fabric panel overlaps a first portion of the right fabric panel adjacent to the bottom horizontal seam, and the bottom horizontal seam is entirely above the first leg opening and the second leg opening.

In some embodiments, the overlap area comprises approximately one quarter of the length of the entire left fabric panel and the entire right fabric panel as measured from the waistband to the bottom horizontal seam.

In some embodiments, the overlap area is less than one third of a total length of the entire left fabric panel and the entire right fabric panel as measured from the waistband to the bottom horizontal seam.

In some embodiments, the left lateral seam of the left fabric panel is connected to the waistband at a first end of the left fabric panel and to the bottom horizontal seam at a second end of the left fabric panel, and the right lateral seam of the right fabric panel is connected to the waistband at a first end of the right fabric panel and to the bottom horizontal seam at a second end of the right fabric panel.

In some embodiments, the left fabric panel and right fabric panels are provided in a first color, and the body portion provided in a second color different from the first color.

In some embodiments, the left fabric panel comprises a first laterally inside edge and a first horizontal edge, and the right fabric panel comprises a second laterally inside edge and a second horizontal edge.

In some embodiments, the left fabric panel comprises a first laterally outside edge connected to the left side periphery of the front pouch, and the right fabric panel comprises a second laterally outside edge connected to a right side periphery of the front pouch.

In some embodiments, the bottom horizontal seam extends toward the first leg opening of the lower longitudinal end of the left leg portion and toward the lower longitudinal end of right left leg portion.

In some embodiments, the left leg seam and the right leg seam circumscribe the first leg opening and the second leg opening.

In some embodiments, the first laterally inside edge is connected to the bottom horizontal seam and the second laterally inside edge is connected to the bottom horizontal seam.

In some embodiments, the first laterally inside edge is connected to the right side periphery of the front pouch and the second laterally inside edge is connected to the left side periphery of the front pouch.

In some embodiments, the first laterally inside edge is connected to the right fabric panel and the second laterally inside edge is connected to the left fabric panel.

In some embodiments, the first horizontal edge is connected to the bottom horizontal seam and the second horizontal edge is connected to the bottom horizontal seam.

In some embodiments, the first horizontal edge is connected to the right side periphery of the front pouch and the second horizontal edge is connected to the left side periphery of the front pouch.

In some embodiments, the first horizontal edge is connected to the right fabric panel and the second horizontal edge is connected to the left fabric panel.

In some embodiments, first laterally outside edge is connected to the left side periphery of the front pouch by a second seam, and the second laterally outside edge is connected to the right side periphery of the front pouch by a third seam.

In some embodiments, the second seam is sewn through at least a portion of the right fabric panel and the third seam is sewn through at least a portion of the left fabric panel.

In some embodiments, the bottom horizontal seam is connected to a left leg seam and a right leg seam that are adjacent the first leg opening and the second leg opening, respectively.

In some embodiments, the bottom horizontal seam is defined as a first seam sewn through the body portion, the front pouch, the left fabric panel, and the right fabric panel.

In some embodiments, the bottom horizontal seam overlaps at least a portion of the second seam and the third seam.

In some embodiments, the pass-through fly opening includes an overlap for through-access of all or a portion of an external male genitalia to be exposed exterior to the boxer brief through the pass-through fly opening when the boxer brief is worn by a wearer.

In some embodiments, the front pouch includes ventilation openings.

BRIEF DESCRIPTION OF THE DRAWINGS

Like reference numbers and designations in the various drawings indicate like elements.

DETAILED DESCRIPTION

This disclosure describes support elements for lower torso garments, for example men's underwear (e.g., boxers, boxer-briefs, briefs, and/or others). Support elements can take a variety of forms, for example, depending on the intended location of support, lower torso garment type, function, flexibility, and/or other factors. Support elements described herein can be used to support at least a portion of the external male genitalia of a wearer of the lower torso garment, where the wearer's external male genitalia is disposed proximate a front pouch region of the lower torso garment. The front pouch region can include a variety of support elements that can provide support for all or a portion of the external male genitalia. For example, the lower torso garment can include a support sling surrounding (partially, substantially, or completely) the front pouch, such as about a periphery of the front pouch. The support sling can include support panels, such as web-like mesh fabric layers, shaped to define, in part, a partially enclosed sling region for at least a portion of the external male genitalia of a wearer to be disposed, where the sling region can include an area between an interior surface of the front pouch and the support panels of the support sling. In some instances, the support elements can include a stitch line or a stitch seam across or along a lower portion of the front pouch of the lower torso garment to provide stretchability, support, or both stretchability and support to the front pouch supporting the male anatomy of a wearer.

Figure 1:
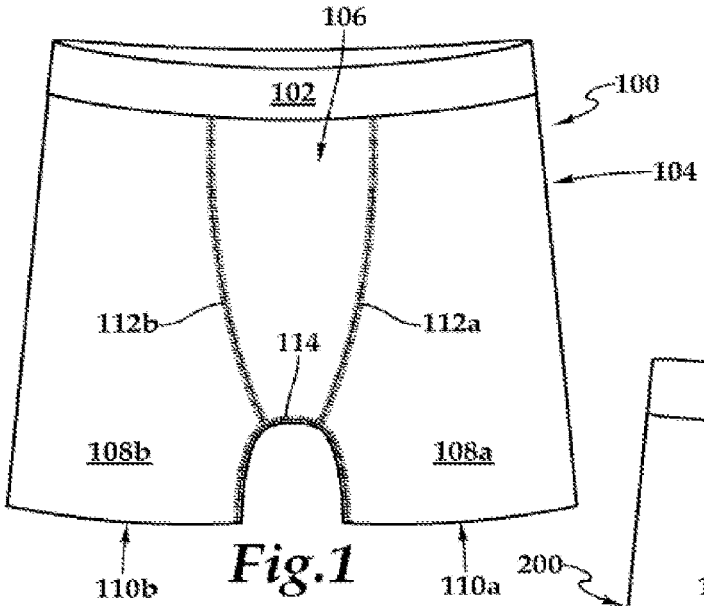
FIG. 1 is a front view of an example lower torso garment.

FIG. 1 is a front view of an example lower torso garment 100, for example, a men's boxer brief The lower torso garment includes a waistband 102 at an upper end of the lower torso garment 100, and a body region 104 including a front pouch 106, a rear buttocks area (not shown), and a left leg region 108*a* and a right leg region 108*b*, each with respective leg openings 110*a* and 110*b* at lower ends of the respective left leg region 108*a* and right leg region 108*b*. The waistband 102 has a torso-encircling shape, and connects to the body region 104, for example, via seamless knitting, stitching, fusing, bonding, adhering, or other connections. With a wearer wearing the example lower torso garment 100, the waistband encircles a torso of the wearer, the front pouch 106 resides adjacent to and supporting at least a portion of the external male genitalia of the wearer, the buttocks region resides adjacent to the buttocks of a wearer, and the left and right leg regions 108*a* and 108*b* receive the legs of the wearer. The front pouch 106 is shown in FIG. 1 as stitched to adjacent fabric of the body region 104 at lateral seams, for example, a left pouch seam 112*a* and a right pouch seam 112*b*; however, the front pouch 106 can connect to adjacent fabric of the body region 104 in a variety of other ways. For example, the front pouch 106 can connect to the adjacent fabric of the body region 104 by knitting (e.g., seamless knitting), stitching, fusing, bonding, adhering, or other connections.

Figure 4A:
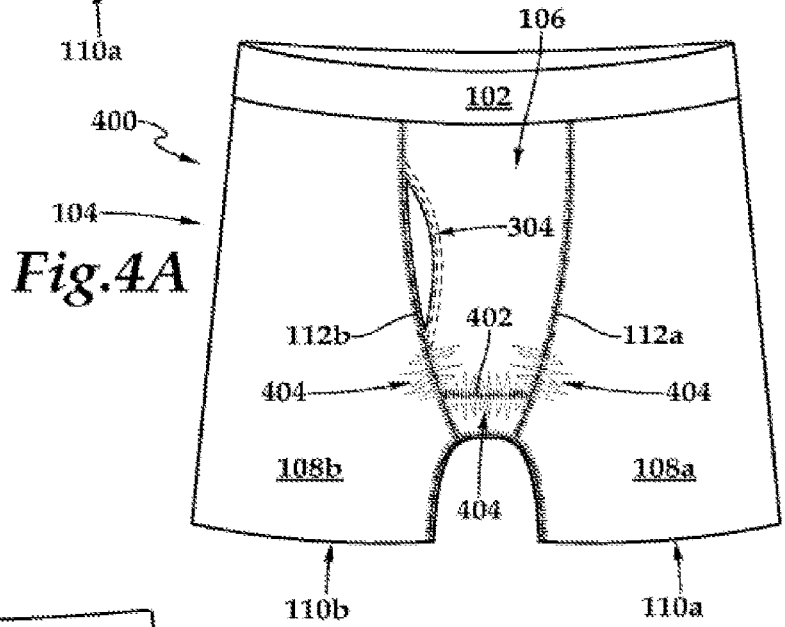
FIGS. 4A-4B are a front view and a cross-sectional interior front view of an example lower torso garment.
Figure 4B:
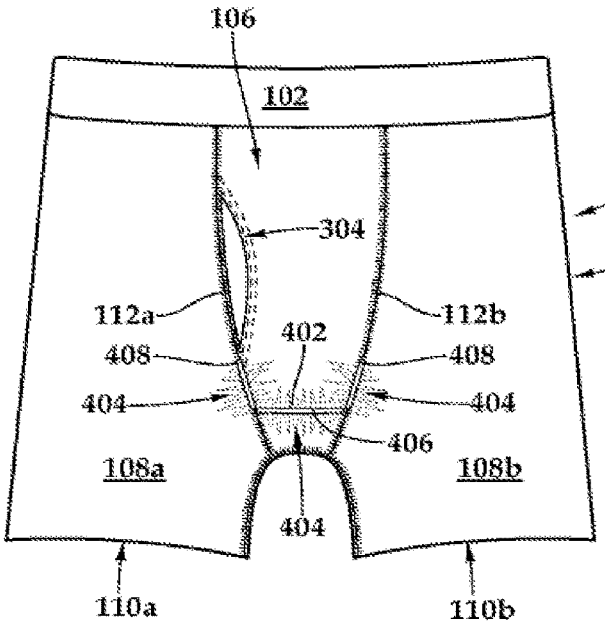

In some implementations, the front pouch 106 of the lower torso garment 100 includes a support element or multiple support elements to provide support, reinforcement, and/or comfort to the front pouch 106 and/or to a wearer of the lower torso garment 100. In certain instances, the support element includes a flexible fabric, such as a flexible mesh fabric. However, the material of the support element can vary, and can be more flexible, less flexible, or the same flexibility as the fabric of the front pouch 106 and/or body region 104. In some examples, the support element of the front pouch 106 includes a support sling disposed at an interior of the garment. The support sling can take a variety of forms, as described in more detail below. In some instances, the body region 104 includes a gusset portion at a bottom of the lower torso garment 100 between the leg regions 108*a* and 108*b*. The lower torso garment 100 can be manufactured in a variety of ways, such as circularly knitting all or most of the lower torso garment 100, cutting fabric to form portions of the lower torso garment 100, and/or stitching together the cut portions of the lower torso garment 100 at stitches or seams joining the garment portions, such as at areas indicated in the drawings. The front pouch 106 can be knit to the body region 104, shown in FIG. 1 as knit at the left and right lateral seams 112*a* and 112*b* about the front portion and a bottom horizontal seam 114 proximate the gusset. In some examples, such as shown in FIGS. 4A and 4B and described in more detail later, the front pouch can include a pass-through fly opening including an overlap, for example, for through-access of all or a portion of the external male genitalia to be exposed exterior to the garment through the pass-through when the garment is worn by the wearer.

Figure 2A:
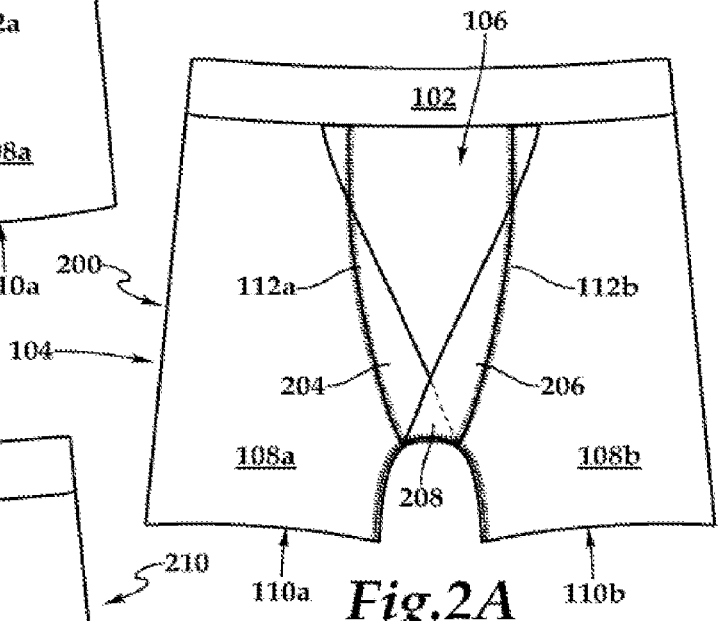
FIGS. 2A-2C are cross-sectional interior front views of example lower torso garments with support structures.

FIG. 2A is a cross-sectional interior front view of an example lower torso garment 200 showing the interior of the front of the lower torso garment 200, for example, the portions of the interior front of the lower torso garment 200 that engage the skin of a wearer of the lower torso garment 200. Example lower torso garment 200 is like the lower torso garment 100 of FIG. 1, except the example lower torso garment 200 includes a support element in the form of a support sling 202 disposed within the body region 104 (i.e., at an interior of the garment) proximate the front pouch 106 and along the left and right lateral seams 112*a* and 112*b* that substantially define the lateral periphery of the front pouch 106. The support sling 202 includes a left fabric panel 204 and a right fabric panel 206 extending from a bottom edge of the front pouch 106 to a top edge of the front pouch adjacent the waistband 102.

Referring to the example lower torso garment of FIG. 2A, the left fabric panel 204 and the right fabric panel 206 of the support sling 202 are disposed in a criss-cross pattern and reside on either side of the front pouch 106 proximate one of the substantially vertical seams 112*a* and 112*b* on the lateral sides of the front pouch 106. The left fabric panel 204 and the right fabric panel 206 can each include a web of fabric that attaches to a periphery of the front pouch 106 and extends between a top and a bottom of the front pouch 106. The left fabric panel 204 and the right fabric panel 206 overlay at least a portion of the fabric of the front pouch 106, for example, to create a pocket for the external male genitalia of the wearer, where all or at least a portion of the external male genitalia of the wearer resides and is supported within the pocket between the fabric of the front pouch 106 and the left and right fabric panels 204 and 206. In some examples, the left fabric panel 204 and the right fabric panel reside between at least a portion of the external male genitalia of the wearer and the inner thigh of the wearer to act as a fabric barrier between skin contact of the inner thigh and the external male genitalia of the wearer. As shown in FIG. 2A, the left fabric panel 204 and the right fabric panel 206 are substantially symmetrical across a vertical centerline of the garment, for example, across a centerline of the front pouch 106. A long-edge of each fabric panel attaches along its edge length to the left or right lateral seam (112*a* or 112*b*, respectively) of the front pouch 106, and a first short edge at one end of each fabric panel attaches proximate the waistband 102 and a second short edge at its other end (e.g., opposite the first short edge) is attached at a bottom of the front pouch 106 (e.g., at the gusset). Each of the fabric panels criss-cross, or twist, between its connection proximate the waistband 102 and its connection at the bottom of the front pouch 106. For example, the left fabric panel 204 criss-crosses along its longitudinal length as it extends from the top of the front pouch 106 to the bottom of the front pouch 106. Similarly, the right fabric panel 206 criss-crosses along its longitudinal length as it extends from the top of the front pouch 106 to the bottom of the front pouch 106. At the one end proximate the waistband 102, the first short edge of the fabric panel (e.g., left fabric panel 204 or right fabric panel 206) extends substantially outwardly (e.g., toward a wearer's side) along the waistband 102, while the second short edge extends substantially inwardly, opposite the direction of first short edge. As shown in FIG. 2A, the left fabric panel 204 and the right fabric panel 206 overlap at an overlap area 208 near a bottom of the front pouch 106, where the overlapped edge of the left fabric panel 204 is indicated in a dashed line. The widths of the left fabric panel 204 and the right fabric panel 206 can partially or completely overlap at its lower attachment to the bottom of the front pouch 106. As the left fabric panel 204 and right fabric panel 206 extend upwards toward the waistband, the overlap area 208 decreases until the fabric panels no longer overlap, creating a substantially triangular area of the overlap area 208.

The left fabric panel 204 and the right fabric panel 206 can include a plurality of materials and fabrics. For example, the fabric panels can include a flexible fabric, such as a flexible mesh fabric, a fabric web, taping, or other material. The material of the support element can vary, and can be more flexible, less flexible, or the same flexibility as the fabric of the front pouch and/or body region. In some instances, the fabric of the body region 104 can include cotton, spandex, a combination of these, and/or other material, the front pouch fabric can include cotton, spandex, a combination of these, and/or other material, the thread (e.g., the seams) can include polyester, cotton, and/or other material, the waistband 102 can include polyester, spandex, and/or other material, and the support sling (e.g., support sling 202) can include polyester, spandex, and/or other material. For example, the fabric panels of the support sling can include a knitted synthetic mesh fabric, such as knitted polyester fiber, a lightweight jersey (e.g., cotton) fabric, can include ventilation openings, and can include spandex or other elastomeric material. The left and right fabric panels can have zero stretch or some degree of stretch (e.g., up to 10%, 20%, 30%, 50%, or more stretch), and the stretch can include a material stretch or a mechanical stretch (e.g., cotton ribs).

In some instances, the support sling (e.g., criss-cross support sling 202) is integrated into the make or construction of the lower torso garment (e.g., boxer brief, or lower torso garment 200) to provide enhanced support as a result of adding the criss-crossed support sling 202 proximate the area of the front pouch 106. By adding the inner sling to the inside of lower torso garment at the front pouch and criss crossing the sling layers (e.g., fabric panels, or webs) at a bottom portion of pouch, the wearer noticeably feels more support, for example, than when wearing a lower torso garment without a sling in the pouch. The sling can be accomplished by using two panels of light weight stretch fabric criss crossed at bottom portion of pouch inside the garment. In some implementations, the criss cross support sling can be added to the pattern for garment make-up and stitched into the seams during construction.

Figure 2B:
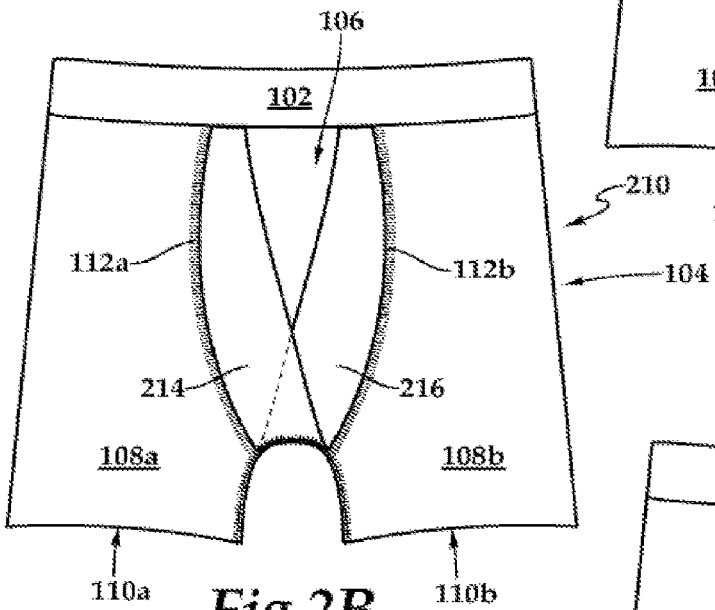

The shape and placement of the support sling can vary. For example, FIG. 2B is a cross-sectional interior front view of an example lower torso garment 210 with a support sling 212, where FIG. 2B shows the interior of the front of the lower torso garment 210. The example lower torso garment 210 and support sling 212 are like the example lower torso garment 200 and support sling 202 of FIG. 2A, except the support sling 212 of lower torso garment 210 includes a substantially planar left fabric panel 214 and right fabric panel 216, where the left fabric panel 214 and right fabric panel 216 do not include a criss-cross, or twist, as the panels extend vertically along the front pouch 106. Instead, a periphery of the support sling 212 remains within the periphery of the front pouch 106. The left fabric panel 214 and the right fabric panel 216 include the overlap area 208 near a bottom of the front pouch 106, where the overlapped edge of the right fabric panel 216 is shown in a dashed line. A laterally outside edge of the left fabric panel 214 connects to and extends along the left lateral seam 112*a*, and a laterally outside edge of the right fabric panel 216 connects to and extends along the right lateral seam 112*b*. Top edges of the left fabric panel 214 and right fabric panel 216 extend laterally inwardly towards each other, leaving a gap between the top edges and the inner edges of the fabric panels that define an opening, for example, for a portion of the external the male genitalia to pass through when a wearer wears the lower torso garment 210.

Figure 2C:
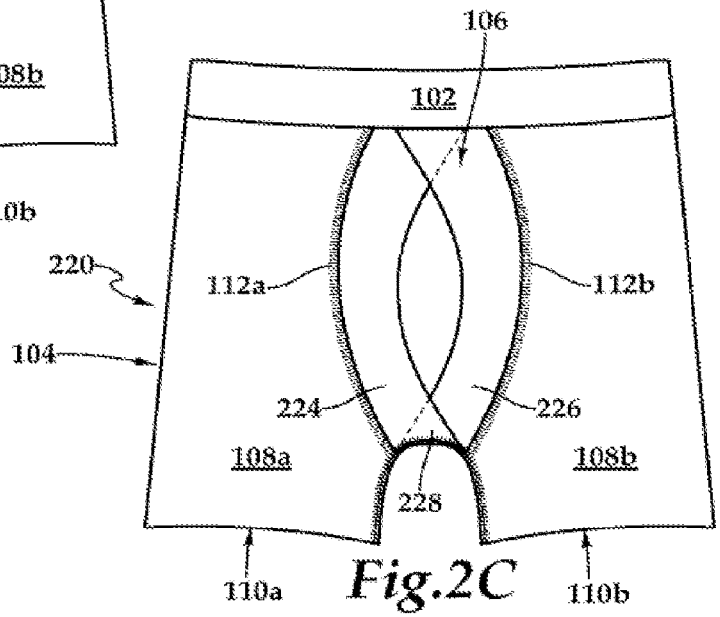

FIG. 2C is a cross-sectional interior front view of an example lower torso garment 220 with a support sling 222, where FIG. 2C shows the interior of the front of the lower torso garment 220. The example lower torso garment 220 and support sling 222 are like the example lower torso garments 200 and 210 and support slings 202 and 212 of FIGS. 2A and 2B, respectively, except the support sling 222 of lower torso garment 220 includes a substantially planar left fabric panel 224 and right fabric panel 226 that overlap each other at a first overlap area 228 at a bottom of the front pouch 106 and also overlap each other at a second overlap area 230 at a top of the front pouch 106. For example, a first portion of the left fabric panel 224 overlaps a first portion of the right fabric panel 226 to define the first overlap area 228, and a second portion of the left fabric panel 224 overlaps a second portion of the right fabric panel 226 to define the second overlap area 230. FIG. 2C shows the first overlap area 228 and second overlap area 230 as substantially the same size; however, the overlap area can be different. For example, the first overlap area 228 can be larger or smaller than indicated in FIG. 2C, and can be larger or smaller than the second overlap area 230. Similarly, the second overlap area 230 can be larger or smaller than indicated in FIG. 2C, and can be larger or smaller than the first overlap area 228.

In some instances, constructing the example lower torso garment (e.g., lower torso garment 200, 210, 220) includes determining the correct placement for the support sling (e.g., support sling 202, 212, 222) on the lower torso garment by fitting the lower torso garment on a fit model and analyzing original garment specs of the lower torso garment (e.g., boxer brief) in which the support sling is to be added. Once placement and pattern are determined, two panels of fabric can be added, one to each side of the pouch inside of garment (at seaming) In some examples, the support sling can be sewn into the garment using the correct stretch direction for the fabric used as the sling. Edges of the sling fabric panels can be edged using a purl stitch, an over edge stitch, a finished edge, a laser-cut edge, a finished seam, a folded seam, or other edge type.

Referring to the example lower torso garment 220 shown in FIG. 2C, the support sling 222 is a key-hole shaped support sling. The keyhole support sling 222 is disposed on an interior of the boxer-brief lower torso garment 220 and lines the periphery of the front pouch 106. The left fabric panel 224 and right fabric panel 226 of the support sling 222 at least partially overlap at the second overlap area 230 at an upper end of the front pouch 106 and at the first overlap area 228 at a lower end of the front pouch 106. A long-edge of each panel of the left fabric panel 224 and the right fabric panel 226 attaches along its edge length to the left or right lateral seam of the front pouch 106, and a first short edge at one end is attached proximate the waistband and the second short edge at its other end is attached at the bottom of the front pouch 106 (e.g., at the gusset). Both the short edges extend substantially inwardly, and can overlap at the upper seam and lower seam of the front pouch 106. The fabric panels create a keyhole-shaped opening between the two fabric panels. The fabric panels can include a plurality of materials and fabrics. In the example lower torso garment 220 of FIG. 2C, the fabric panels include a mesh fabric.

In some instances, the keyhole support sling can be constructed by adding to each side of the pouch inside of the lower torso garment (e.g., at the seaming) the two pieces of fabric that cross over one another at the top and bottom of pouch to create the key hole sling and support for the wearer. The keyhole support sling can be sewn into the garment using the correct stretch direction for the sling fabric. Edges of sling fabric panels can be edged using a purl over edge stitch for comfort.

The left fabric panel (204, 214, 224) and the right fabric panel (206, 216, 226) of the support sling (202, 212, 222) of the lower torso garments (200, 210, 220) of FIGS. 2A-2C can be disposed in a variety of locations and positions, and can include various materials and constructions. For example, the left and right fabric panels can include a single ply fabric panel or a multi-ply fabric panel (e.g., dual ply fabric panel), and the inner edges of the fabric panels can include a purl stitch, an over-edge stitch, a finished edge, a laser-cut edge, a finished seam, a folded seam, or other edge type.

The front pouch 106 can act as a basket sling that acts as a support basket for the external male genitalia of a wearer, and can provide for multi-directional support of the external male genitalia, for example, during movement and/or activity of the wearer.

Figure 3:
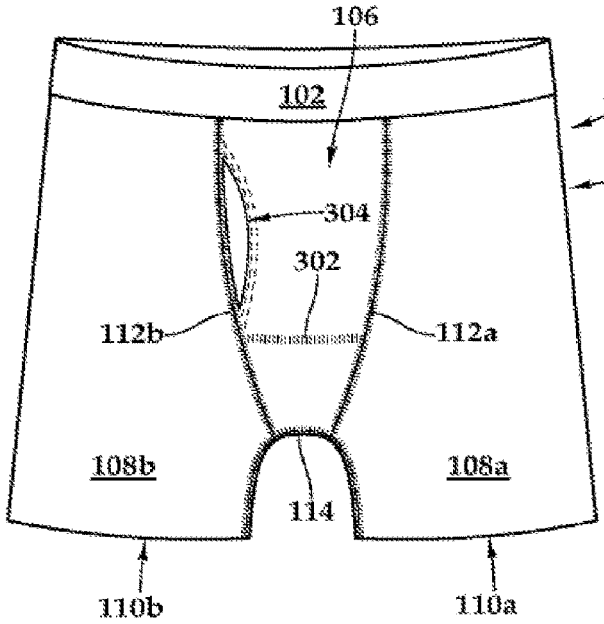
FIG. 3 is a front view of an example lower torso garment.

FIG. 3 is a front view of an example lower torso garment 300, similar to the lower torso garments 200, 210, 220 of FIGS. 2A-2C, except (at least) the front pouch includes a support element in the form of a support stitch line 302 extending horizontally (substantially or exactly) between the lateral side seams 112*a* and 112*b* at the periphery of the front pouch 106, and the lower torso garment 300 includes a pass-through fly opening 304 including an overlap, for example, for through-access of the external male genitalia to be exposed exterior to the garment through the pass-through when the garment is worn by the wearer. The example lower torso garment 300 of FIG. 3 does not include a support sling described earlier with respect to FIGS. 2A-2C; however, the example lower torso garment 300 can include one or more of the other support elements, support structures, and/or support slings described herein. In some instances, the lower torso garment 300 excludes the fly opening 304. The support stitch line 302 is illustrated as extending between the left and right lateral seam 112*a* and 112*b* of the front pouch 106 proximate a front-bottom area of the front pouch. The horizontal seam extends between the left and right front pouch seam to provide support for the crotch region of a wearer of the garment. The horizontal seam can include a cover stitch, over edge stitch, flatlock seam, or other type of stitch or seam. The SPI (stiches per inch) can vary. For example, the SPI can be about 13 (e.g., between 11 and 15), or different (e.g., between 5 and 20). The front pouch 106 can include two layers of fabric (e.g., two-ply fabric), and the horizontal seam can be sewn through both layers of the front pouch fabric.

The type and placement of the support stitch line 302 can vary. For example, FIG. 3 shows the support stitch line 302 as placed just below the fly opening 304 (e.g., within one or two inches of the fly opening edge), about two-thirds (⅔) down the longitudinal length of the front pouch 106 from the top of the front pouch 106, or one-third (⅓) up the longitudinal length of the front pouch 106 from the bottom of the front pouch 106. However, the location of the support stitch line 302 can vary, for example, the support stitch line 302 can be located vertically higher or lower than the position indicated in FIG. 3.

The support stitch line 302 can take a variety of forms. Although the support stitch line 302 is described herein in some instances as including a seam, the support stitch line 302 may not be a seam or a stitch. Instead, the support stitch line 302 can include a support element, such as a tape or other attachment that can fuse, bond, adhere, or otherwise attach to the front pouch 106 of the lower torso garment 300, between fabric layers of the front pouch 106, or otherwise connect to the front pouch. For example, the support stitch line 302 can include a stitch-sew line extending laterally across the front pouch 106, taping that is fused, adhered, or otherwise attached to the front pouch, other material that is fused or bonded to the fabric of the front pouch 106, sew thread that is knit, woven, stitched, or otherwise connected to the front pouch, and/or other materials. In some examples, the support stitch line 302 includes a width of up to an inch (e.g., ¼ inches, ½ inches, ¾ inches, or another width dimension). In some instances, the support stitch line 302 can provide some degree of stretch. In some examples, the support stitch line 302 has less stretch than the fabric of the front pouch 106, for example, to provide strength and/or support to the front pouch in addition to or in lieu of a gusset.

FIGS. 4A and 4B are a front view and a cross-sectional interior front view, respectively, of an example lower torso garment 400, similar to lower torso garment 300 of FIG. 3, where the example lower torso garment includes a support stitch line 402 extending horizontally (substantially or exactly) between the lateral side seams 112*a* and 112*b* at the periphery of the front pouch 106. FIG. 4B shows the interior of the front of the example lower torso garment 400. In some instances, such as shown in the example lower torso garment 400 of FIGS. 4A and 4B, the support stitch line 402 is a horizontal support seam that creates gathers 404 in the fabric about (e.g., surrounding) a support seam. In some instances, this support stitch line 402 includes one or more elastic elements 406 (e.g., elastomeric elements, or other elements effecting an elastic/elastomeric/stretch characteristic of the stitch) integrated into the support stitch line 402, for example, at an interior side of the front pouch 106. The elastic element(s) 406 biases the horizontal support stitch line 402 to compress edges of adjacent fabric edges to create the fabric gathers 404 (e.g., extra body fabric, fabric folds, fabric wrinkles, and/or other forms of gathers) in the fabric of the front pouch 106 surrounding the horizontal support stitch line 402. The fabric gathers 404 allow a greater degree of stretch to the fabric of the front pouch 106 (e.g., than fabric without gathers), and allows space for the external male genitalia of a wearer of the lower torso garment 400. The support stitch line 402 can extend between a left and right seam of the front pouch 106 proximate a front-bottom area of the front pouch 106, and includes the elastic element 406.

The type and placement of the support stitch line 402 can vary. For example, FIGS. 4A and 4B show the support stitch line 402 as placed below the fly opening 304 (e.g., within one or two inches of the fly opening edge). However, the location of the support stitch line 402 can vary, for example, the support stitch line 402 can be located vertically higher or lower than the position indicated in FIGS. 4A and 4B.

The support stitch line 402 can take a variety of forms. Although the support stitch line 402 is described herein in some instances as including a seam, the support stitch line 402 may not be a seam or a stitch. Instead, the support stitch line 402 can include a support element, such as a tape or other attachment that can fuse, bond, adhere, or otherwise attach to the front pouch 106 of the lower torso garment 400, between fabric layers of the front pouch 106, or otherwise connect to the front pouch. For example, the support stitch line 402 can include a stitch-sew line extending laterally across the front pouch 106, taping that is fused, adhered, or otherwise attached to the front pouch, other material that is fused or bonded to the fabric of the front pouch 106, sew thread that is knit, woven, stitched, or otherwise connected to the front pouch, and/or other materials. In some examples, the support stitch line 402 includes a width of up to an inch (e.g., ¼ inches, ½ inches, ¾ inches, or another width dimension). In some instances, the support stitch line 402 can provide some degree of stretch. In some examples, the support stitch line 402 has less stretch than the fabric of the front pouch 106, for example, to provide strength and/or support to the front pouch in addition to or in lieu of a gusset.

In some instances, the horizontal support stitch line 402 and adjacent portions of the left lateral side seam 112*a* and right lateral side seam 112*b* of the front pouch 106 (e.g., portions of the left and right seams extending upward from the horizontal seam) can include elastic elements 408 stitched, tacked, bonded, fused, or otherwise integrated into the lateral side seams 112*a* and 112*b*. The elastic elements 408 can extend to a portion of the length of the lateral side seams 112*a* and 112*b*, for example, ¼ of the length, ⅓ of the length, or another portion of the length of the lateral side seams 112*a* and 112*b* beginning at the intersection of the support stitch line 402 and the respective lateral side seams 112*a* and 112*b* of the front pouch 106. In some examples, the generally vertical elastic elements 408 extend along the sew line of the lateral side seams 112*a* and 112*b*, while the elastic element 406 of the horizontal support stitch line 402 extends across the fabric of the front pouch 106. In some implementations, the elastic element 406 and/or the elastic elements 408 are stitched when in a stretched state and where the adjacent fabric is in a relaxed (e.g., un-stretched state), and where returning the elastic element(s) to its un-stretched state creates the fabric gathers 404 about the horizontal support stitch line 402 and/or the adjacent portions of the left lateral side seam 112*a* and right lateral side seam 112*b* of the front pouch 106. The elastic elements and the fabric gathers 404 provide for a volume (e.g., increased volume) of the sling region while maintaining, increasing, or otherwise affecting the support of the front portion at the horizontal seam and/or at other seam areas. The elastic element 406 and/or the elastic elements 408 can take a variety of forms. For example, an elastic element can include a strip or band of elastomeric material, an elastomeric thread, a stretchy sew tape, or other elements with a degree of stretch greater than the degree of stretch of the fabric of the front pouch 106. Although the support stitch line 402 is described herein in some instances may include a seam, the support stitch line 402 may not be a seam or a stitch. Instead, the support stitch line 402 can include a support element, such as a tape or other attachment that can fuse, bond, adhere, or otherwise attach to the front pouch 106 of the lower torso garment 400.

In some instances, the gathered horizontal stitch line or seam is constructed by determining the correct placement of the gathered stitch line or seam on the lower torso garment, which is done by fitting on a fit model and analyzing original garment specs of the boxer brief in which the stitch line or seam is to be added. Once placement is determined, elastic can be added to the inside of garment at bottom of pouch while stretching the elastic during sewing to create gathers in the fabric. The SPI (stitches per inch) can include an SPI of 13, but can vary, for example, between 5 and 20. The gathering stitches work best (e.g., supports best) when sewn through both layers of the pouch fabric.

A gathered support pouch creates support for the wearer of the lower torso garment. A conventional way to add support on this type of garment is by adding a gusset. A gusset can include a piece of fabric, generally in a rectangle or diamond shape, inserted in a garment to allow for more space and greater ease of movement. In men's underwear, for example, the gusset appears along the inseams and crotch area of garment. Although a conventional gusset does provide support, it may not provide any additional shaping to a front pouch, whereas a gathered pouch does provide an increase in support and comfort for the wearer.

A number of implementations have been described. Nevertheless, it will be understood that various modifications may be made without departing from the spirit and scope of the disclosure.

The invention claimed is:

1. A boxer brief, comprising:

a waistband at an upper end of the boxer brief;

a body portion;

a left leg portion comprising a first leg opening at a lower longitudinal end of the left leg portion;

a right leg portion comprising a second leg opening at a lower longitudinal end of the right leg portion;

a front pouch disposed about a front region of the body portion and provided in the form of a mesh fabric, the front pouch further defining a pass-through fly opening;

a gusset positioned at a bottom of the body portion between the left leg and right leg portions of the body portion, the gusset connected to the front pouch with a bottom horizontal seam at a bottom of the front pouch, and the bottom horizontal seam being entirely above the first leg opening and the second leg opening;

a support sling connected to the front pouch, the support sling comprising:

a left fabric panel comprising a left lateral seam and an exterior left lateral seam on the opposing side of the left fabric panel, the exterior left lateral seam extending along a left side periphery of the front pouch and connected to the bottom horizontal seam; and a right fabric panel comprising a right lateral seam and an exterior right lateral seam on the opposing side of the right fabric panel, the exterior right lateral seam extending along a right side periphery of the front pouch and connected to the bottom horizontal seam; and wherein a first portion of the left fabric panel overlaps a first portion of the right fabric panel at an overlap area, the overlap area positioned adjacent to the bottom horizontal seam at the bottom of the front pouch.

2. The boxer brief of claim 1, wherein the overlap area comprises approximately one quarter of the length of the entire left fabric panel and the entire right fabric panel as measured from the waistband to the bottom horizontal seam.

3. The boxer brief of claim 1, wherein the overlap area is less than one third of a total length of the entire left fabric panel and the entire right fabric panel as measured from the waistband to the bottom horizontal seam.

4. The boxer brief of claim 1, wherein the left lateral seam of the left fabric panel is connected to the waistband at a first end of the left fabric panel and to the bottom horizontal seam at a second end of the left fabric panel, and the right lateral seam of the right fabric panel is connected to the waistband at a first end of the right fabric panel and to the bottom horizontal seam at a second end of the right fabric panel.

5. The boxer brief of claim 1, wherein the left fabric panel and right fabric panel are provided in a first color, and the body portion is provided in a second color different from the first color.

6. The boxer brief of claim 1, wherein the bottom horizontal seam extends toward the first leg opening of the lower longitudinal end of the left leg portion and toward the lower longitudinal end of right left leg portion.

7. The boxer brief of claim 6, wherein the bottom horizontal seam is connected to a left leg seam and a right leg seam that are adjacent the first leg opening and the second leg opening, respectively.

8. The boxer brief of claim 7, wherein the left leg seam and the right leg seam circumscribe the first leg opening and the second leg opening.

9. The boxer brief of claim 1, wherein the pass-through fly opening includes an overlap for through-access of all or a portion of an external male genitalia to be exposed exterior to the boxer brief through the pass-through fly opening when the boxer brief is worn by a wearer.

10. A boxer brief comprising:

a body portion;

a left leg portion comprising a first leg opening at a lower longitudinal end of the left leg portion;

a right leg portion comprising a second leg opening at a lower longitudinal end of the right leg portion;

a front pouch disposed about a front region of the body portion;

a gusset positioned at a bottom of the body portion between the two leg portions of the body portion, the gusset connected to the front pouch with a bottom horizontal seam at a bottom of the front pouch;

a mesh support sling connected to the front pouch, the mesh support sling comprising:

a left fabric panel comprising a first lateral outside edge extending along a left side periphery of the front pouch and comprising a left lateral seam adjacent to the first lateral outside edge and connected to the bottom horizontal seam; and a right fabric panel comprising a second lateral outside edge extending along a right side periphery of the front pouch and comprising a right lateral seam adjacent to the second lateral outside edge and connected to the bottom horizontal seam; and wherein a first portion of the left fabric panel overlaps a first portion of the right fabric panel at an overlap area, the overlap area positioned adjacent to the bottom horizontal seam at the bottom of the front pouch, and the bottom horizontal seam is entirely above the first leg opening and the second leg opening.

11. The boxer brief of claim 10, wherein the front pouch includes ventilation openings.

* * * * *